United States Patent [19]

Harmon

[11] Patent Number: 4,488,207

[45] Date of Patent: Dec. 11, 1984

[54] STATIC MULTI-COLOR LIGHT SIGNAL

[75] Inventor: Kevin E. Harmon, Brentwood, Pa.

[73] Assignee: American Standard Inc., Wilmerding, Pa.

[21] Appl. No.: 524,255

[22] Filed: Aug. 18, 1983

[51] Int. Cl.[3] ..... F21V 9/00

[52] U.S. Cl. ..... 362/231; 362/236; 362/240; 362/241; 362/263; 362/268; 362/293; 362/307; 362/308; 362/310; 362/311; 362/331; 362/362; 362/375

[58] Field of Search ..... 362/231, 236, 240, 241, 362/263, 268, 293, 307, 308, 310, 311, 362, 375, 331

[56] References Cited

U.S. PATENT DOCUMENTS

| | | | |
|---|---|---|---|
| 4,071,809 | 1/1978 | Weiss et al. | 362/231 X |
| 4,206,494 | 6/1980 | Lovering | 362/293 X |
| 4,430,695 | 2/1984 | Payne et al. | 362/231 X |

*Primary Examiner*—Stephen J. Lechert, Jr.
*Attorney, Agent, or Firm*—John B. Sotak

[57] ABSTRACT

A static-type of multi-color searchlight signal for displaying one of a plurality of color signals including a plurality of parabolic reflectors, each having a focal point at which an associated "white light" source is located so that light rays are collected and reflected in a substantially parallel configuration, a plurality of color filters, one of which is disposed in front of each one of the plurality of parabolic reflectors for passing a given color of the parallel light rays and for absorbing all other colors, a plurality of dichroic filters situated in the optical path of the passed parallel light rays and having an angle of incidence which corresponds to the angle of incidence of the passed parallel light rays, and a lens system for projecting the passed parallel light rays for providing a color signal aspect.

14 Claims, 2 Drawing Figures

STATIC MULTI-COLOR LIGHT SIGNAL

FIELD OF THE INVENTION

This invention relates to an improved inert multi-color searchlight signal and, more particularly, to a light signal unit having a plurality of white light lamps and associated parabolic reflectors for emitting parallel rays of white light which passes through different colored filters which chromatically separate the white light into different colors which are played onto a series of angularly-disposed dichroic filters which either transmit or reflect the different colors onto a lens system which will project a color indication in accordance with which one of the plurality of white light lamps is illuminated.

BACKGROUND OF THE INVENTION

In the past, it was common practice to employ a three-position operative searchlight signal unit having an operating assembly which is located and mounted in a protective casing. The means for generating the luminous radiation includes a single lamp which emitted achromatic or white light. The light was focused at the conjugate focal point of a polished elliptical reflector and a plano convex objective lens. The optical filtering system included a three-position relay that positioned one of three colored roundel mobile assemblies interposed between the lamp and objective lens. When the relay is deenergized, it will assume a neutral control position to give a red indication. The other two positions have green and yellow color filters. Thus, these types of signal units must rely upon the transitional displacement by an electromechanical device which is a distinct disadvantage. In addition to the need of periodic maintenance, such as, lubricating and adjusting, there is always the possibility of mechanical breakdown or malfunction of the relay. In order to alleviate the shortcomings of such dynamic signal units, it was previously proposed to redesign the searchlight unit as a static device having no moving parts. The previous static searchlight signal unit employed a plurality of lamps and associated elliptical reflectors and color filters in combination with a pair of dichroic filters and objective lens to produce a colored signal light of one of a given number of colors. In practice, the dichroic filters are angularly-disposed at forty-five degrees (45°) with respect to the axis of objective lens and to the axis of the focal point of some of the elliptical reflectors. Further, the dichroic filters are generally selected by their passband and rejection and angle of incidence is the determining factor for performance of the filtering action. In most cases, the dichroic filters are accurate over the visible spectrum within a range of plus or minus fifteen degrees (±15°) of the specified angle of incidence, and beyond this fifteen degree angle, the transmitted rays are shifted toward the red end of the spectrum. Presently, there are no dichroic reflectors available that can accommodate light rays that have a continually varying angle of incidence and, therefore, it is difficult and virtually impossible to conform the spectrum chromaticity required by the Association of American Railroads (AAR).

OBJECTS OF THE INVENTION

Accordingly, it is an object of this invention to provide a new and improved searchlight signal unit which alleviates the above-noted shortcomings.

Another object of this invention is to provide a unique static color signal light for projecting one of a plurality of luminous colors having an acceptable chromaticity.

A further object of this invention is to provide a color searchlight signal unit which employs a plurality of "white light" lamps, parabolic reflectors, color filters, dichroic filters, and lens system to project a selected color light.

Yet another object of this invention is to provide a novel multi-color passive signal light which projects a single dominant wavelength of color.

Yet a further object of this invention is to provide a passive searchlight signal unit having a source of radiant energy-emitting light rays which are reflected by a reflector in such a way that all the refelected light rays strike a dichroic filter at substantially the same angle of incidence so that the light rays from the dichroic reflector have a substantially similar hue.

Still another object of this invention is to provide a static searchlight signal unit which is economical in cost, efficient in operation, durable in use, unique in design, dependable in service, and easy to manufacuture.

Still a further object of this invention is to provide a multi-color static signal light unit comprising, at least one lamp for light rays, at least one parabolic reflector for reflecting the light rays in a substantially parallel orientation, at least one color filter for absorbing certain wavelengths of the light rays and for passing other wavelengths of the light rays, and at least one inclined dichroic filter having a given angle of incidence for receiving the passed wavelengths of the light rays at substantially the same angle of incidence as the angle of incidence of the dichroic filter and for conveying the passed wavelengths of the light rays onto a lens system which projects a signal light having homogeneous hue.

SUMMARY OF THE INVENTION

Briefly, in accordance with the present invention, there is provided a searchlight signal for projecting a selected one of a plurality of color signals including at least three parabolic reflective mirrors. A tungsten-halogen lamp is positioned at the focal point of each of the parabolic reflective mirrors which collect and reflect the light rays produced by the illuminated halogen lamp in a parallel configuration. A different colored filter is disposed in front of each of the three parabolic reflective mirrors for passing a certain color of the parallel light rays and for absorbing all other colors. A pair of dichroic filters having a preselected angle of incidence and being disposed at an angle such that the passed colored parallel light rays strike the dichroic filters at the preselected angle of incidence. The passed colored parallel light rays are directed to a lens system which projects a color signal in accordance with which one of three tungsten-halogen lamps is illuminated.

DESCRIPTION OF THE DRAWINGS

The above objects and other attendant features and advantages of the present invention will become more readily understood when considered in conjunction with the following detailed description of the accompanying drawings, wherein.

DETAILED DESCRIPTION OF THE INVENTION

Figure 1:
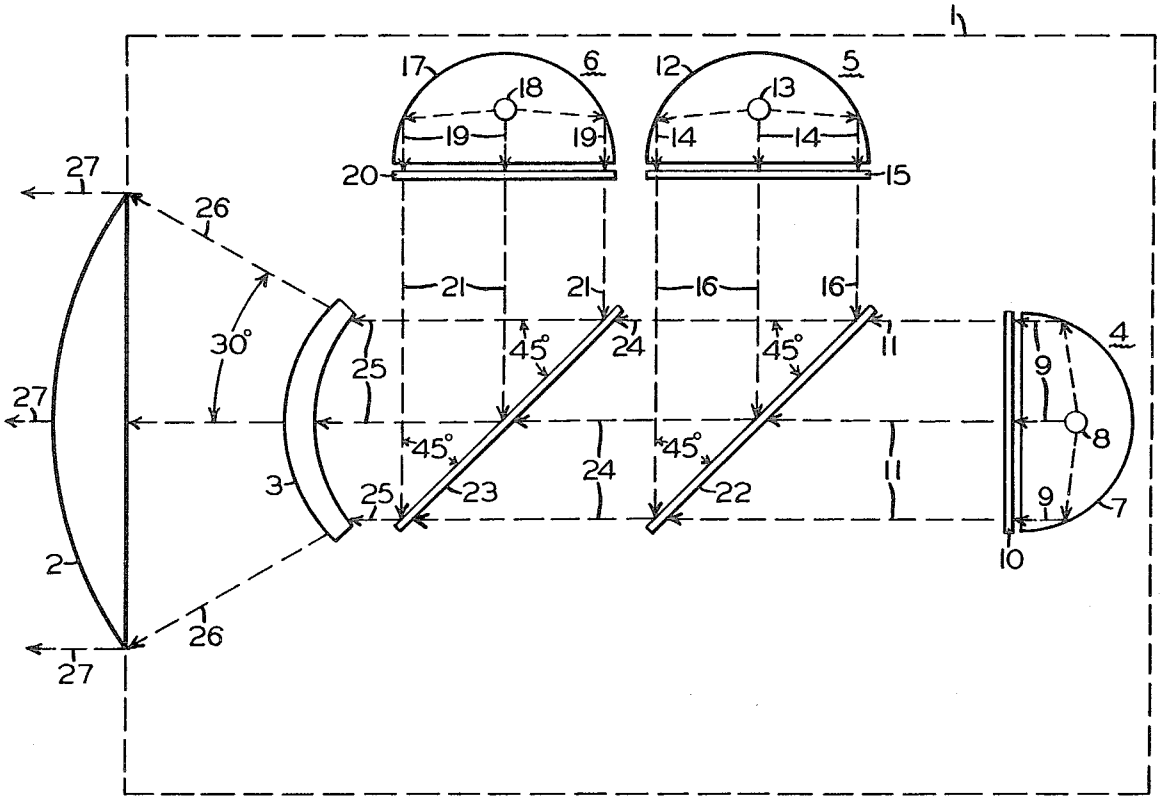
FIG. 1 is a diagrammatic view showing one form of a multi-color searchlight signal in accordance with the present invention.

Referring to the drawings, and in particular to FIG. 1, there is shown a static multi-color light signal or three-color searchlight signal embodying my invention for varying the color aspect of the light rays emitted by the signal. The components of the signal unit are mounted and housed within a suitable weatherproof casing which is depicted by the dashed lines 1. A large circular opening is provided in the front of casing or housing 1 for accommodating the outer objective lens 2 of a positive lens system. The doublet lens system includes a meniscus lens 3 for diverging the color signal light rays in an appropriate spread to meet the outer plano-convex lens for projecting the searchlight beam which may be readily observed by an oncoming trainman or the like. It will be seen that there are three light units 4, 5, and 6 housed within casing 1. In railroad applications, the searchlight signal must be capable of projecting a red signal, indicating "stop"; a yellow signal, indicating "caution"; and a green signal, indicating "proceed".

As shown, the first red unit 4 includes a parabolic or elliptic paraboloid reflector 7 having its inner surface provided with a highly polished multi-faceted mirror. A source of white light, such as, a tungsten-halogen lamp 8, is located at the focal point of the parabolic mirror 7 which collects the light energy emanating from the lamp and reflects those light rays 9 in a direction substantially parallel to each other and to the optical axis of the reflector. A partially transparent film or glass, such as, a red filter 10, is located in front of reflector 7 so that the parallel white light rays are filtered by color. Thus, the red filter 10 passes the specified wavelengths of light 11 between approximately 633–700 millimicrons (mμ) and absorbs substantially all the other colors of the visible spectrum.

It will be seen that the second yellow unit 5 includes a parabolic reflector 12 having a highly polished multi-faceted inner mirror surface which effectively collects and reflects the radiant energy produced by halogen lamp 13. The white light rays 14 are reflected in a substantially parallel configuration toward a yellow-colored filter 15. Thus, the yellow filter 15 passes the parallel light rays 16 having wavelengths in the approximate range of 589–597 mμ and absorbs substantially all of the other wavelengths of light. It will be noted that the parabolic mirror 12 is disposed at a ninety degree (90°) relationship with respect to parabolic mirror 7.

A third green unit 6 includes a parabolic reflector 17 having an inner multi-faceted mirror surface for collecting and reflecting the light emanating from the halogen lamp 18. The white light rays 19 are reflected in substantially a parallel direction toward a green-colored filter 20. The filter 20 passes the green-colored light rays 21 of 498–512 mμ and absorbs substantially all of the other colors of white light. It will be noted that the passed green-colored light rays 21 are parallel to the passed yellow-colored light rays 16, both of which are perpendicular to the passed red-colored light rays 11.

It will be seen that the passed colored light rays are directed toward and impinge upon a pair of angularly-disposed dichroic filters 22 and 23. The dichroic filter 22 is a red filter element having a transmission of less than one percent (1%) in the wavelength range of 420–560 mμ and having a transmission of more than eighty-five percent (85%) in the wavelength range of 660–720 mμ. The dichroic mirror 23 is a yellow filter element having a transmission of approximately one percent (1%) in the wavelength range of 440–510 mμ and having a transmission of more than eighty-five percent (85%) in the wavelength range of 580–700 mμ. Both of the filters have a selected angle of incidence of forty-five degrees (45°) since the impinging light rays strike the surface at forty-five degrees (45°). It will be seen that the two dichroic mirrors 22 and 23 are centrally located on the axes of lenses 2 and 3 and parabolic mirrors 7, 12, and 17 in order to minimize the light losses and to maximize the intensity of the project light signal.

Now, in describing the operation of the searchlight signal, let us assume that the red signal unit 4 is illuminated while the yellow and green units 5 and 6 are deenergized. Under this condition, a red "stop" signal is projected from the objective lens 2. That is, the passed red light rays 11 emanating from lamp 8, reflector 7, and filter 10 strike and pass through the first dichroic filter 22, as indicated by light rays 24. The red light rays 24 then strike and pass through the second dichroic filter 23, as indicated by light rays 25. The red meridional light rays 26 are spread approximately thirty degrees (30°) from the center line by the diverging lens 3 toward the objective lens 2 which bends the beam to the required eight and one-half inch diameter parallel beam. Thus, a red signal 27 is projected by the searchlight signal to caution an engineer of the train.

Now, when the dangerous condition passes, it is desirable to permit the train to proceed along its route of travel. Thus, the red signal unit 4 is extinguished by turning off lamp 8 and then either lamp 13 or 18 is energized to cause either a yellow or green signal to be displayed by the searchlight unit. If the yellow signal unit 5 is illuminated, the yellow light rays 16 emanating the lamp 13, reflector 12, and filter 15 strike the first dichroic filter 22 at 45° and are reflected without a shift in color since the angle of incidence is for both axial and meridional rays. The reflected yellow light rays 24 strike and pass through the second dichroic filter 23, as indicated by rays 25. The yellow rays are diverged by lens 3 and a yellow signal light is projected by lens 2 to indicate to a trainman to proceed under caution.

Now, when the route of travel is unimpeded, it is desirable to display a green "clear" indication. Under this condition, the yellow signal unit 5 is extinguished, the red signal unit 4 remains extinguished, but the halogen lamp 18 is energized. Thus, the green light rays 21 emanating from the lamp 18, reflector 17, and filter 20 strike the second dichroic filter at 45° and are reflected without a shift in color since the angle of incidence is 45° for both axial and meridional rays. Again, the green rays 25 are spread 30° from the center by diverging lens 3 and a green signal light is projected by lens 2 to indicate a green "clear" signal.

It will be appreciated that the associated external electrical circuits ensure that only one of the halogen lamps 8, 13, or 18 will be energized at any given time so that a single pure signal will be displayed by the presently-described static searchlight signal.

Figure 2:
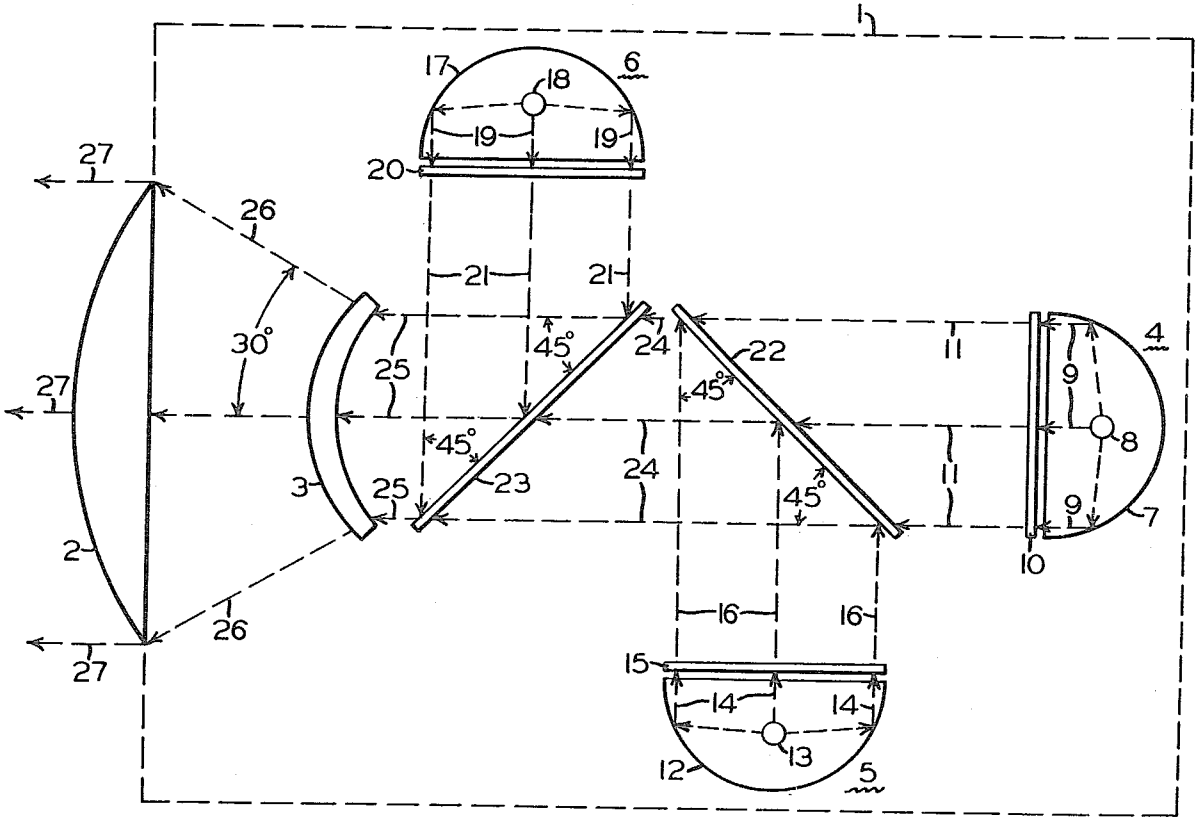
FIG. 2 is a diagrammatic view showing another form of a static color signal light in accordance with the present invention.

Turning now to FIG. 2, it will be seen that the searchlight signal of this embodiment is similar to that of FIG. 1 except that the yellow signal unit 5 has been transposed 180°. As shown, the parallel green light rays are directed upwardly as viewed in FIG. 2. In order to accommodate the upwardly-directed green light rays, the first dichroic mirror is displaced ninety degrees (90°) but still is at a forty-five degree (45°) angle with respect to the axes of lenses 2 and 3 and parabolic mirror 12. The searchlight signal of FIG. 2 operates in substantially the same manner as the signal of FIG. 1 and, therefore, a detailed description on the operation is believed to be unnecessary.

It will be appreciated that various changes and modifications may be made to the presently-described embodiment without departing from the spirit and scope of the present invention. For example, the angle of incidence of the dichroic filters may be changed or selected in order to optimize the chromaticity range of the light. The transmission wavelengths of the color filters and dichroic filters may be chosen in accordance with the desired colors of the signals. The number of white light sources and dichroic mirrors may be increased dependent upon the number of desired aspect signals required in any given installation. Thus, it will be appreciated that the various substitutions, variations, and equivalents will undoubtedly occur to those skilled in the art which will fall within the purview of the present invention and which will be encompassed within the spirit and scope of the appended claims.

Having thus described my invention what I claim as new and desire to secure by Letters Patent, is:

1. A multi-color light signal unit comprising, at least one lamp for producing light rays, at least one parabolic mirror for reflecting the light rays in a substantially parallel orientation to the axial ray, at least one color filter for transmitting specific wavelengths of the light rays and for reflecting or absorbing all other wavelengths of the light, and at least one inclined dichroic filter of selected angle of incidence for receiving the passed wavelengths of the light at substantially the same angle of incidence as the angle of incidence of the dichroic filter and for conveying the passed wavelengths of the light onto a lens system which projects a signal light of homogeneous hue.

2. The multi-color signal light unit, as defined in claim 1, wherein said lamp includes a halogen lamp which emits "white light".

3. The multi-color signal light unit, as defined in claim 1, wherein said inclined dichroic filter is disposed at a forty-five degree angle with respect to the focal axis of said lens.

4. The multi-color light signal unit, as defined in claim 1, wherein said lens includes a diverging meniscus lens.

5. The multi-color light signal unit, as defined in claim 1, wherein said parabolic mirror includes a multi-faceted reflective surface.

6. The multi-color light signal unit, as defined in claim 1, wherein said color filter passes specified range of red light rays and absorbs all other color light rays.

7. The multi-color light signal unit, as defined in claim 1, wherein said color filter passes specified range of green light rays and absorbs all other color light rays.

8. The multi-color light signal unit, as defined in claim 1, wherein said color filter passes specified range of yellow light rays and absorbs all other color light rays.

9. The multi-color light signal unit, as defined in claim 1, wherein said dichroic filters transmit the red light rays.

10. The multi-color light signal unit, as defined in claim 1, wherein said dichroic filter reflects the green light rays.

11. The multi-color light signal unit, as defined in claim 1, wherein said respective dichroic filters reflect and transmit the yellow light rays.

12. A searchlight light for projecting a select one of a plurality of color signals comprising, a plurality of parabolic reflectors, each having a focal point at which an associated "white light" source is located so that light rays are collected and reflected in a substantially parallel configuration, a plurality of different color filters, one of which is disposed in front of each one of said plurality of parabolic reflectors for passing a given color of the parallel light rays and for absorbing all other colors, a plurality of dichroic filters, each having a preselected angle of incidence, said plurality of dichroic filters situated in the optical path of the passed parallel color light rays and disposed at an angle which substantially corresponds to the angle of incidence so that the passed parallel color light rays remain within the selected chromaticity range, and lenses for projecting the selected colors.

13. The searchlight signal, as defined in claim 12, wherein one of said dichroic filters reflects yellow and lower wavelength light rays and transmits all higher wavelength light rays.

14. A searchlight signal comprising, a plurality of parabolic reflectors, each having a focal point at which an associated "white light" source is located so that the light rays are collected and reflected in substantially a parallel configuration, a plurality of different color filters, one of which is disposed in front of each of said parabolic mirrors to pass a given color of the parallel light rays and to absorb all other colors, a plurality of inclined dichroic filters situated in the optical path of the passed parallel color light rays, each of said plurality of dichroic filters having a selected angle of incidence which corresponds to the angle of incidence at which the passed parallel color light rays strike each of said plurality of dichroic filters, and a lens system for projecting the passed parallel color light rays.

* * * * *